United States Patent [19]

Komendant

[11] 4,195,453

[45] Apr. 1, 1980

[54] MODULAR, MULTI-FLOOR BUILDING

[76] Inventor: August E. Komendant, 205 Highland Ave., Upper Montclair, N.J. 07043

[21] Appl. No.: 850,111

[22] Filed: Nov. 9, 1977

[51] Int. Cl.[2] ..... E04H 1/04

[52] U.S. Cl. ..... 52/79.13; 52/79.14

[58] Field of Search ..... 52/79.2, 79.3, 79.13, 52/79.14, 236.7, 236.3

[56] References Cited

U.S. PATENT DOCUMENTS

| | | | |
|---|---|---|---|
| Re. 29,249 | 6/1977 | Rice | 52/236.5 |
| 2,202,745 | 5/1940 | Muse | 52/602 |
| 2,645,114 | 7/1953 | Armirikian | 52/79.14 |
| 3,292,327 | 3/1969 | van der Lely | 52/236.5 |
| 3,564,795 | 2/1971 | Henton | 52/79.7 |
| 3,594,965 | 7/1971 | Saether | 52/745 |
| 3,694,977 | 10/1972 | Verman | 52/79.13 |
| 3,703,058 | 11/1972 | Klett | 52/583 |
| 3,710,527 | 1/1973 | Farebrother | 52/236.7 |
| 3,742,660 | 7/1973 | Bierweiler | 52/587 |
| 3,805,461 | 4/1974 | Jagoda | 52/79.2 |
| 3,835,601 | 9/1974 | Kelbish | 52/79.2 |
| 3,855,743 | 12/1974 | Wokas | 52/79.1 |
| 3,882,649 | 5/1975 | Mah et al. | 52/252 |

*Primary Examiner*—John E. Murtagh
*Attorney, Agent, or Firm*—John J. Byrne

[57] ABSTRACT

Disclosed are modular, multi-floor buildings wherein each floor comprises a plurality of semi-boxes which are cast from concrete as independent, rigid units and which are basically rectangular in shape, comprising mutually perpendicular walls but no floor or ceiling. The semi-boxes are arranged between horizontal concrete slabs, which function as both floors and ceilings, and a plurality of vertical posttensioning tendons pass through the semi-boxes and the slabs to bind the building together.

7 Claims, 7 Drawing Figures

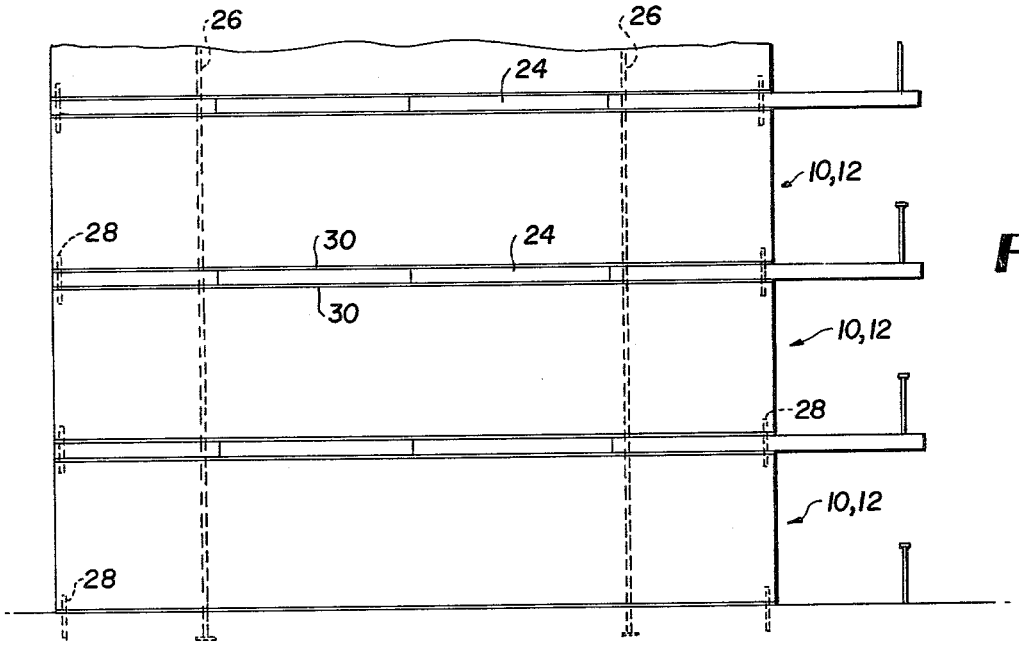
FIG. 4
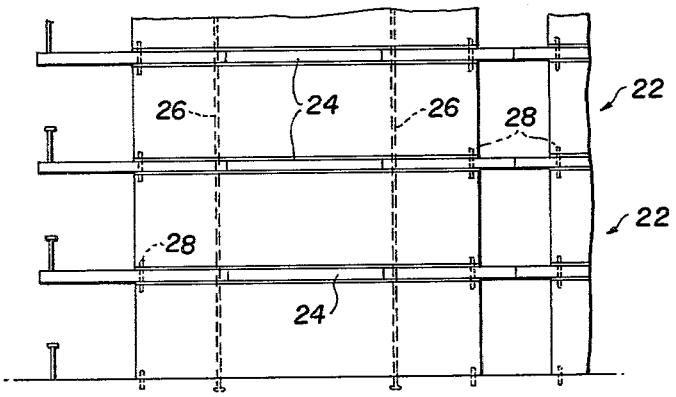
FIG. 5
FIG. 7
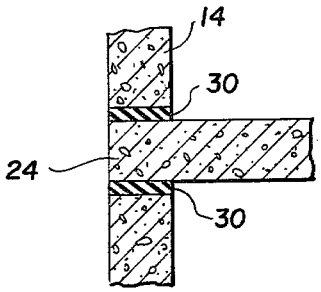
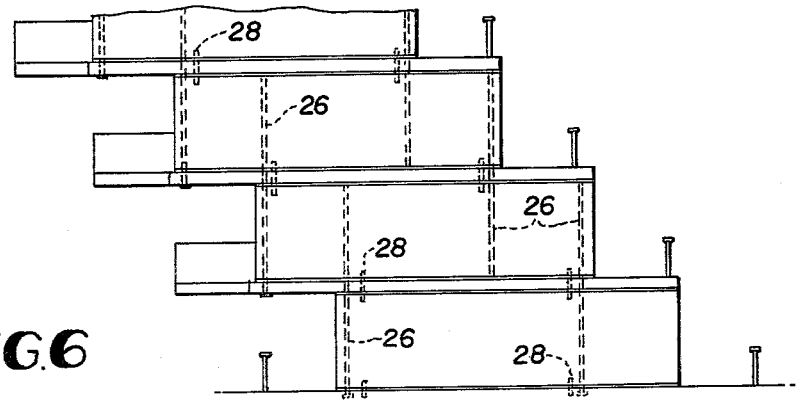
FIG. 6

MODULAR, MULTI-FLOOR BUILDING

FIELD OF THE INVENTION

This invention relates to modular, multi-floor buildings. In particular, it relates also to such buildings in which the primary structural components can be cast from concrete on the construction site.

BACKGROUND OF THE INVENTION

At present there are basically two prefabricated concrete building systems: the panel system and the modular box system. However, neither of these systems has been extensively utilized. The reasons for this are mainly as follows.

In the panel system, erection is difficult because proper alignment of the vertical panels is time consuming and guides have to be used to secure stability. Moreover, the connections of the vertical panels are relatively weak, requiring dry-packing (which is also time consuming) and very often permitting leakage. Due to these factors, the panel system is particularly unsuitable for locations where buildings are subjected to severe dynamic forces, such as earthquakes and hurricanes.

In the box system, the molds for casting the boxes are very expensive. Stripping the mold from the concrete is difficult, and the time required for the stripping operation is controlled by the hardening of the concrete, which can be time consuming even when steam curing is applied. In particular, the horizontal slabs are subject to bending due to the dead load of the slab unless the concrete is thoroughly cured before the mold is stripped from it. Due to this fact, the expensive molds cannot be used efficiently; in particular, it has been my experience that only one box can be produced in 24 hours per mold. Moreover, the weight of the boxes themselves is more than 50 tons for stone concrete and about 35 to 40 tons for light-weight concrete. Boxes of such heavy weight require extremely high capacity construction equipment, including erection cranes with lifting capacities of 100 tons or even more for construction of high-rise buildings.

OBJECTS OF THE INVENTION

It is, therefore, a general object of the invention to provide modular, multi-floor buildings which will obviate or minimize problems of the type previously described.

It is a particular object of the invention to provide such a building which is suitable for locations which are subjected to severe dynamic forces.

It is another object of the invention to provide such a building which can be erected quickly and inexpensively (in comparison to the prior art).

It is a further object of the invention to provide such a building in which the molds can be used more efficiently, producing more units per day, than the prior art.

It is yet a further object of the invention to provide such a building in which the individual structural units can be handled with relatively low capacity construction equipment.

Other objects and advantages of the present invention will become apparent from the following detailed description of several preferred embodiments taken in conjuction with the accompanying drawings.

THE DRAWINGS

FIG. 4 is a side view of the building shown in FIG. 3.

FIG. 5 is a side view in schematic form of a second building according to the subject invention.

FIG. 6 is a side view in schematic form of a third building according to the subject invention.

FIG. 7 is a view on a larger scale along the lines 7—7 in FIG. 3.

DETAILED DESCRIPTION OF THE PRESENTLY PREFERRED EMBODIMENTS

Figure 1:
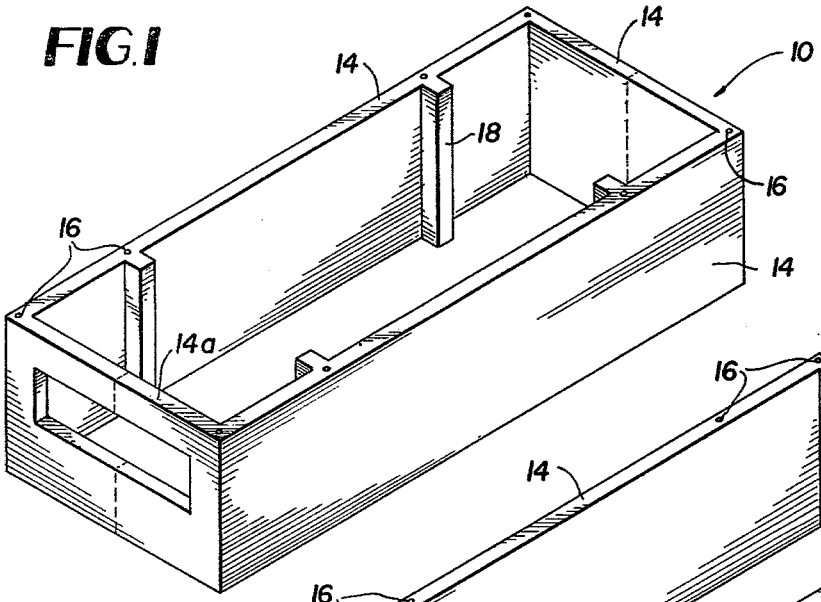
FIG. 1 is a perspective view of a first embodiment of a semi-box used in the subject invention.
Figure 2:
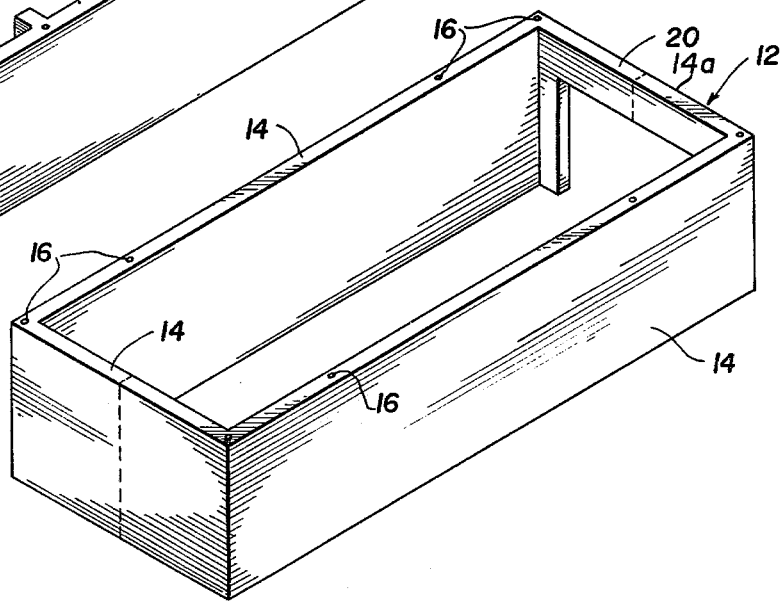
FIG. 2 is a perspective view of a second embodiment of a semi-box used in the subject invention.

Referring now particularly to FIGS. 1 and 2, there will be seen perspective views of two embodiments 10 and 12 of the semi-boxes which form a basic structural component of a modular building according to the subject invention. Each of these embodiments can be readily cast from concrete as an independent, rigid unit at the construction site. Each is basically rectangular in shape, comprising mutually perpendicular walls 14 and 14*a*, but no floor or ceiling. The end walls 14*a* in the embodiment of FIGS. 1 and 2 can be walls or frames, as architecturally required. Passageways 16 for posttensioning tendons (described hereinafter) are provided in the walls. In the embodiment of FIG. 1, the walls of the semi-box are reinforced by ribs 18, while in the embodiment of FIG. 2 walls are thicker—no ribs. The semi-boxes can be poured in two channel shapes having vertical joints in front walls or frames and then joined into rigid semi-boxes. Additional door openings and window openings as appropriate may also be provided in the walls 14. The window and door frames (not shown) are molded into the concrete when the semi-box is poured in the manner well known for panel and box construction of the prior art. The windows and doors are then installed and surface-cleaned ready to receive paint on the ground level before erection.

Figure 3:
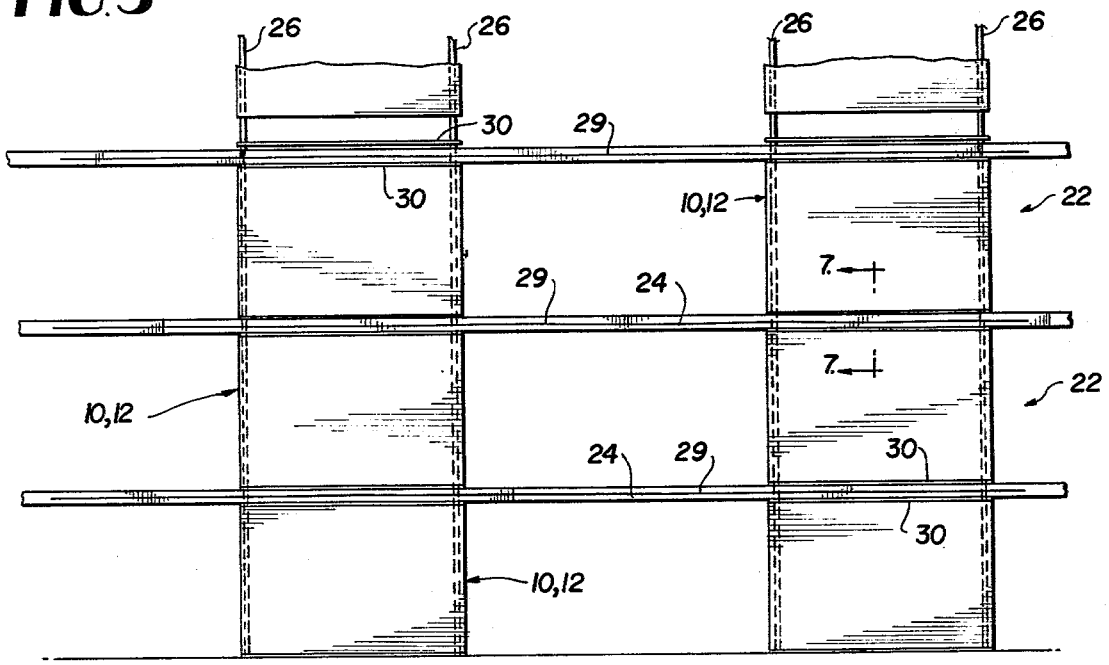
FIG. 3 is an end (or front) view in schematic form of a first building according to the subject invention.

Referring now to FIGS. 3, 4, and 7, there will be seen a first embodiment of a building according to the subject invention. It comprises a plurality of floors 22 each of which comprises a plurality of semi-boxes 10 or 12. A plurality of horizontal continuous concrete prefabricated slabs 24 are provided to function as both ceilings and floors for the building, and the semi-boxes 10 or 12 are arranged between the slabs 24 as architecturally required. A plurality of vertical posttensioning tendons 26 pass through the passageways 16 in the semi-boxes 10 or 12 and through corresponding holes in the slabs 24 to posttension the system into structural unity. As best seen in FIG. 3, the semi-boxes 10 or 12 are spaced from one another and have no horizontal interconnection with each other. Shear dowels 28 are provided in a manner known per se to take the base shear between the semi-boxes 10 or 12 and the slabs 24. While not necessary in all environments, the slabs 24 can also be posttensioned to unity in the longitudinal and transverse directions of the building by horizontal posttensioning tendons 29. As best seen in FIG. 7, layers 30 of a resilient substance such as neoprene are preferably provided between the walls 14 of the semi-boxes and the slabs 24 at both the top and the bottom of each semi-box. (It should be noted that the thickness of the layer 30 is greatly exaggerated in FIG. 7 for ease of illustration; in actual practice the layers 30 are only several millimeters thick.)

The structural system according to this invention comprises a plurality of semi-boxes stacked vertically above each other and separated by continuous floor-ceiling slabs forming column stations. The column stations are spaced in the longitudinal and transverse directions as architecturally required. Further examples of such spacing are shown in FIGS. 5 and 6.

The posttensioning can be applied in sections for the column stations to secure safety and stability, and the equalization of deflection of the walls having different rigidities (due to different openings in the walls, etc.) is accomplished by providing different elongation lengths of the tendons. Such sectional posttensioning is especially advantageous in areas where dynamic forces may occur.

In dynamic loading conditions, the walls of the semi-boxes act as simply supported elements due to the two-point support of the walls; that is, the tensile reaction is taken by the posttensioning tendons, resulting only in secondary tensile stresses in the concrete, and the compression reaction is distributed by the resilient layers 30 through slabs over the semi-box walls of the column stations. As previously stated, the base shear is taken by the shear dowels 28. The resilient interfaces between the semi-boxes and the slabs eliminate dry-packing and also increase the ductility of the column stations resulting in reduced dynamic forces and also in reducing bending stresses, stress concentration in vertical walls, and noise propagation from floor to floor.

The molds for the casting of the semi-boxes are rather simple and inexpensive in comparison with the molds of other box types. By the use of "hot" concrete (the hardening time of which is about three hours), three semi-boxes can be produced each day from each mold. Using regular concrete and heated molds, two semi-boxes can be produced each day from each mold. Moreover, the plant for manufacturing the semi-boxes and the horizontal slabs is readily movable and can be rapidly and inexpensively dismantled, moved and re-erected in a new location.

The weight of the semi-boxes is only about forty percent of that of comparable complete boxes (i.e., roughly twenty tons), permitting the use of considerably lighter and less expensive handling, transporting, and erection equipment.

CAVEAT

While the present invention has been illustrated by detailed descriptions of several preferred embodiments thereof, it will be obvious to those skilled in the art that various changes in form and detail can be made therein without departing from the true scope of the invention. For that reason, the invention must be measured by its claims appended hereto and not by the foregoing preferred embodiments.

What is claimed is:

1. In a modular, multi floor building comprising:

(a) a plurality of horizontal continuous concrete slabs between which rooms are arranged as architecturally required, said rooms being cast from concrete as independent, rigid units, and (b) a plurality of vertical posttensioning tendons passing through the walls of said rooms and said slabs to posttension the building into structural unity, the improvements wherein:

(c) said rooms are defined by a plurality of semi-boxes, said semi-boxes being basically rectangular in shape, comprising mutually perpendicular walls or front frames but no floor or ceiling, and (d) said horizontal slabs are posttensioned to unity in the horizontal plane.

2. A building are recited in claim 1 and further comprising layers of a resilient substance between said semi-boxes and said horizontal slabs.

3. A building as recited in claim 2 wherein said layers are made of neoprene.

4. A building as recited in claim 1 and further comprising shear dowels connecting said semi-boxes to said horizontal slabs.

5. A building as recited in claim 1 wherein the walls of said semi-boxes are reinforced by ribs.

6. A building as recited in claim 1 wherein the thickness of walls is uniform.

7. A building as recited in claim 1 wherein said semi-boxes are assembled from two channel sections.

* * * * *